US008060950B1

(12) United States Patent
Thornton

(10) Patent No.: US 8,060,950 B1
(45) Date of Patent: Nov. 22, 2011

(54) EAR-SHADING HAT ATTACHMENT

(76) Inventor: Charles E. Thornton, Linden, MI (US)

( * ) Notice: Subject to any disclaimer, the term of this patent is extended or adjusted under 35 U.S.C. 154(b) by 283 days.

(21) Appl. No.: 12/462,444

(22) Filed: Aug. 4, 2009

(51) Int. Cl.
*A42B 1/06* (2006.01)

(52) U.S. Cl. ..... 2/209

(58) Field of Classification Search ..... 2/10, 209.13, 2/209

See application file for complete search history.

(56) References Cited

U.S. PATENT DOCUMENTS

| | | | | |
|---|---|---|---|---|
| 280,005 | A | 6/1883 | Beard et al. | |
| 899,334 | A | 9/1908 | Seitzman | |
| 2,442,825 | A | 5/1946 | Rabushka | |
| 2,676,325 | A | 4/1954 | Carlson | |
| 2,878,479 | A | 3/1959 | Schuessler | |
| 3,077,607 | A | 12/1960 | Bregenzer | |
| 4,486,903 | A | 12/1984 | Krystal | |
| 4,845,782 | A | 7/1989 | Gregg | |
| D315,439 | S | 3/1991 | Lorentzen, Jr. | |
| 5,119,514 | A | 6/1992 | Woehl | |
| 5,121,507 | A | 6/1992 | Brown | |
| 5,125,113 | A | 6/1992 | Yun | |
| D337,645 | S | 7/1993 | Guziejka | |
| D340,796 | S | 11/1993 | Oates | |
| 5,351,343 | A | 10/1994 | Harbison | |
| 5,406,645 | A | 4/1995 | Lin | |
| 5,426,790 | A | 6/1995 | Robertson | |
| 5,465,426 | A | 11/1995 | Beaton | |
| 5,493,733 | A | 2/1996 | Pospisil | |
| D368,153 | S | 3/1996 | Amey | |
| 5,548,847 | A | 8/1996 | Spicijaric | |
| 5,649,327 | A | 7/1997 | Crewe | |
| 5,675,840 | A * | 10/1997 | Clavelle | 2/174 |
| 5,701,607 | A | 12/1997 | Kaiser | |
| D399,338 | S | 10/1998 | Lund | |
| 5,860,165 | A | 1/1999 | Cvijanovich | |
| 5,862,520 | A | 1/1999 | Wyant | |
| 6,079,052 | A | 6/2000 | Veridiano | |
| 6,131,201 | A | 10/2000 | Chu | |
| 6,233,745 | B1 | 5/2001 | Friesen | |
| 6,550,064 | B2 | 4/2003 | Schmitt et al. | |
| D478,710 | S | 8/2003 | Yan | |
| 6,857,134 | B1 | 2/2005 | Cowell | |
| D518,943 | S | 4/2006 | Levinson | |
| 7,134,147 | B2 | 11/2006 | Yount | |
| 7,578,007 | B2 * | 8/2009 | McIntyre | 2/181.4 |
| 2006/0107440 | A1 | 5/2006 | Keffer | |
| 2006/0168708 | A1 | 8/2006 | Moshier | |
| 2007/0033707 | A1 * | 2/2007 | Stone | 2/209 |

* cited by examiner

*Primary Examiner* — Katherine Moran
(74) *Attorney, Agent, or Firm* — Flint Patent Service; Jack E. Tubbs

(57) ABSTRACT

An ear shading hat attachment includes a movable flap portion and a stationary flap portion associated with the flap, two spring hinges formed between the movable flap portion and the stationary flap portion capable of flexing in response to a desired amount of tensioning applied to the spring hinges, wherein the desired amount of tensioning is equal to or ranges between a minimum or a maximum amount of tensioning; and a slot disposed between the spring hinges adapted to control the spring strength of the spring hinges, wherein the stationary flap portion forms part of the stationary base, and wherein the movable flap portion pivots about the stationary base to position the movable flap portion in either a stowed position and a deployed position.

20 Claims, 9 Drawing Sheets

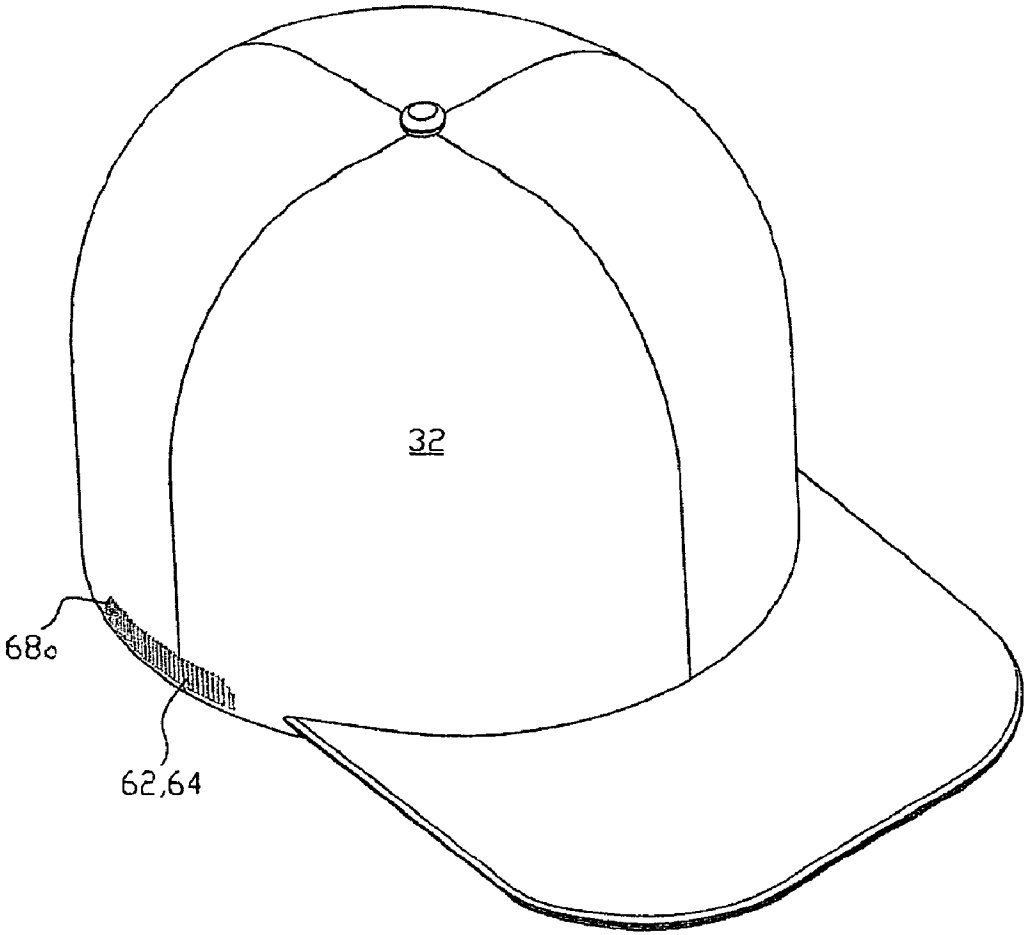
FIG. 12
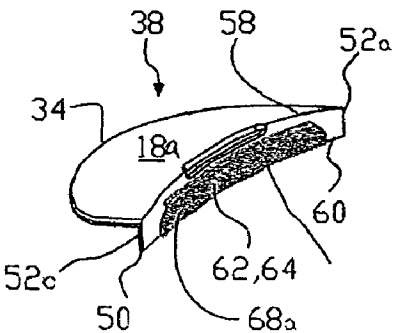

EAR-SHADING HAT ATTACHMENT

FIELD OF THE INVENTION

The present invention generally relates to devices for shading a user's ears from the sun and more particularly to a pair of ear shades that may be attached to a hat.

BACKGROUND OF THE INVENTION

The use of devices and methods relating to protective ear coverings are disclosed in U.S. Pat. No. 6,550,064 issued in the name of Schmitt et al., U.S. Pat. No. 5,493,733 issued in the name of Pospisil, U.S. Pat. No. 5,426,790 issued in the name of Robertson, U.S. Pat. No. 7,134,147 issued in the name Yount, and U.S. Pat. No. 5,121,507 issued in the name of Brown.

While existing devices suit their intended purpose, the need remains for a device that may be selectively deployed by a user, does not interfere with a user's field of vision, may be selectively attached to or removed from a hat, and displays desirable indicia thereupon.

It is well known that the exposure of human skin to sunlight may, in large amounts, cause certain undesirable effects. These effects may include, but are not limited to sunburns and skin cancers. Much attention in recent years has been focused upon warning people of the dangers of overexposure to the sun's rays and the ultra violet (UV) rays attendant thereto. However, there are many outdoor pursuits, both recreational and occupational, that expose people's skin to potentially dangerous amounts of sunlight.

Many outdoor activities or sporting events, such as golf, require a person to spend a great deal of time in unshaded portions of the outdoors, such as a fairway on a golf course. Furthermore, many participants in these types of activities have preferred types of clothing or headgear that is worn during the activities.

Spectators of outdoor activities or sporting events also commonly spend a great deal of time in unshaded areas. Spectators at such events may oftentimes be exposed to even greater amounts of sunlight than participants, as the spectators may be forced to remain in a single location during the event, rather than moving from place to place, as do the participants. The location of a spectator may be such that the location does not have any significant shade during the course of an entire day, due to the requisite large and open spaces required to accommodate large numbers of spectators.

Sporting events are generally viewed by a great number of spectators. Referring in particular to a professional golf match, there are generally many thousands of spectators in attendance compared to the number of professional golfers competing. Most spectators have preferred types of clothing and headgear, similar to that worn by participants.

The clothing and headgear that is worn during these activities, while being preferred by the participants and spectators, may not provide the most desirable level of protection from the incident UV rays of the sun impinging the skin of a user. Therefore, what is needed is a device that operates to provide protection of a user's skin from UV rays, while at the same time allowing a user to continue to wear and use their preferred headgear.

The present invention provides a pair of ear-shading hat attachments that may be selectively deployed by a user in order to provide shade for the ears of a user, such that undesirable effects from UV exposure of the user's skin may be minimized.

SUMMARY OF THE INVENTION

An ear shading hat attachment including a flap having an outer flap periphery defined by a flap peripheral edge, an inner flap surface, and a lower flap surface, wherein each of the inner flap surface, the lower flap surface, and the flap peripheral edge cooperating to define a flap thickness; at least two spring hinges, each spring hinge having an associated spring hinge axis coaxial with each other respective spring hinge axis and formed on opposing ends of a spring hinge slot and adapted to hingably retain the flap in mechanical engagement with a base; a spring hinge slot having two opposing slot ends and having a predefined length and a predefined width and adapted to allow each of the flap and each respective spring hinge to pivot thereabout while retaining a predefined curvature; and a base hingably affixed to the flap by the spring hinges, having a predefined curvature, and adapted to be fixed in secure mechanical engagement to a hat In another embodiment, the ear shading hat attachment includes a movable flap portion and a stationary flap portion associated with the flap, two spring hinges formed between the movable flap portion and the stationary flap portion capable of flexing in response to a desired amount of tensioning applied to the spring hinges, wherein the desired amount of tensioning is equal to or ranges between a minimum or a maximum amount of tensioning; and a slot disposed between the spring hinges adapted to control the spring strength of the spring hinges, wherein the stationary flap portion forms part of a stationary base, and wherein the movable flap portion pivots about the stationary base to position the movable flap portion in either a stowed position and a deployed position.

BRIEF DESCRIPTION OF THE DRAWINGS

These and other objects, features and advantages of the present invention will become apparent from the following detailed description and the appended drawings in which:

FIG. 12 illustrates a partial perspective view of an ear shading hat attachment and a hat, each having removable mechanical fasteners affixed thereto in accordance with an embodiment of the invention.

DETAILED DESCRIPTION OF THE INVENTION

The present invention relates generally to protective ear coverings, and more particularly, to selectively deployable ear coverings.

Generally provided is a device for shading a user's ears from the sun and more particularly to a pair of ear shade hat attachments adapted to be removably or permanently secured or attached to a hat.

Figure 1:
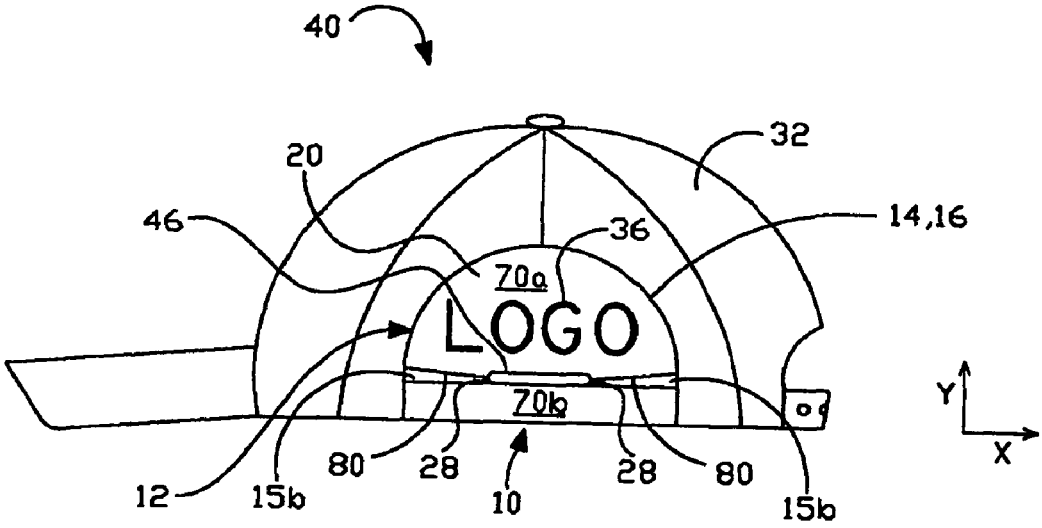
FIG. 1 illustrates a front elevation view of an ear shading hat attachment and hat in a stowed position in accordance an embodiment of the invention.

Referring now to the drawings, FIGS. 1-14 generally illustrate an embodiment of an ear shading hat attachment 10. Generally, as shown in FIG. 1, the ear shading hat attachment 10 includes a flap 12 capable of removably or permanently attaching to a hat and capable of moving between a stowed (shown in FIGS. 1-8) and a deployed position (shown in FIGS. 9-14) relative to a stationary base 30.

In an embodiment of the invention, the ear shading hat attachment includes a movable flap portion and a stationary flap portion associated with the flap, two spring hinges formed between the movable flap portion and the stationary flap portion capable of flexing in response to a desired amount of tensioning applied to the spring hinges, wherein the desired amount of tensioning is equal to or ranges between a minimum or a maximum amount of tensioning; and a slot disposed between the spring hinges adapted to control the spring strength of the spring hinges, wherein the stationary flap portion forms part of the stationary base, and wherein the movable flap portion pivots about the stationary base to position the movable flap portion in either a stowed position and a deployed position.

Figure 2:
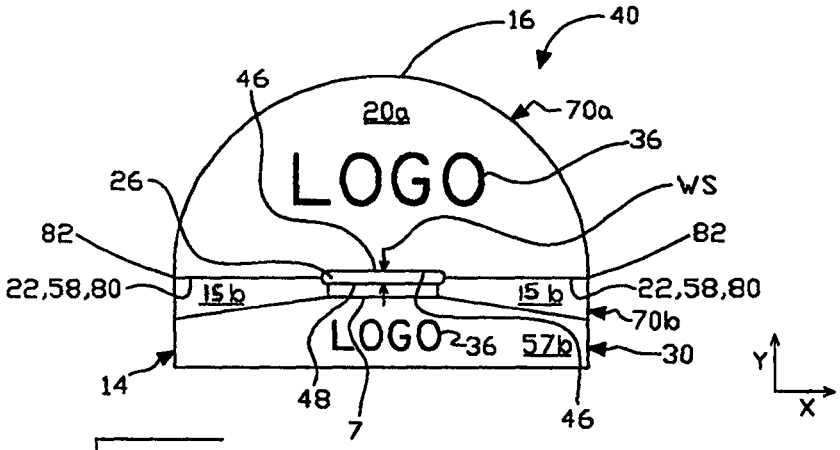
FIG. 2 illustrates a front elevation view of an ear shading hat attachment in accordance an embodiment of the invention.
Figure 3:
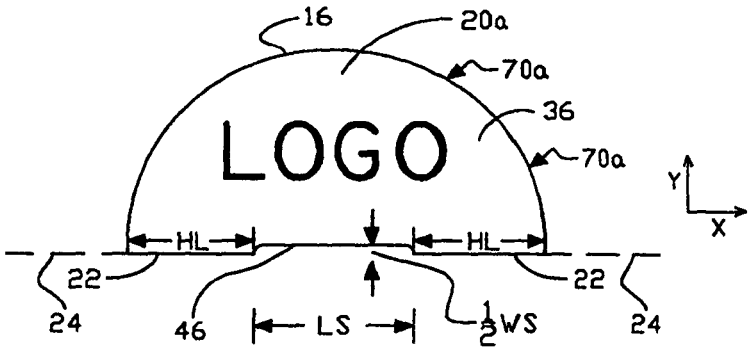
FIG. 3 illustrates a front elevation view of the free end of the flap inner movable surface 20*a* in FIG. 2 including indicia affixed thereto in accordance with an embodiment of the invention.
Figure 4:
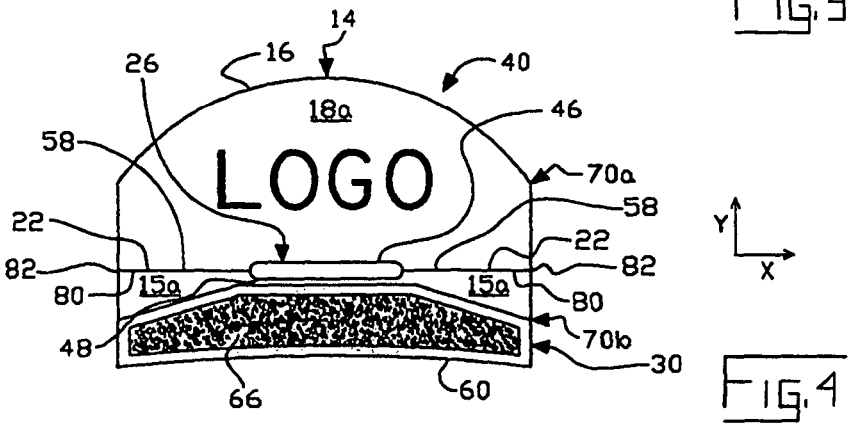
FIG. 4 illustrates a rear elevational view of a backside of a flap inner movable surface 20*a* in FIG. 2.

As shown in more detail in FIGS. 2-4 the flap 12 has a movable flap portion 70*a*, and a stationary flap portion 70*b*. In one embodiment of the invention, the flap 12 may be formed from materials including, but not limited to: plastics, thermoplastics, non-metallic composites, or any other material providing sufficient rigidity and durability to provide sufficient shade to a user's ears while maintaining a predefined curvature.

In one embodiment of the invention, each of the movable flap portion 70*a*, the two spring hinges 22, the spring hinge slot 26, and the base 30 may be integrally formed together. Each of the movable flap portion 70*a*, the at least two spring hinges 22, the spring hinge slot 26, and the base 30 may be integrally formed together by processes including, but not limited to: injection molding.

As shown in FIGS. 1, 2-4, The movable flap portion 70*a* is bounded a periphery edge 14 defining the contours of the movable flap portion 70*a* including an upper peripheral edge 16 and a lower periphery defining a movable curvilinear edge 80 having opposing ends 82 each contacting a portion of the peripheral edge 16, the movable curvilinear edge having a variable curvature depending on the position of the movable flap portion 70*a* with respect to the stationary base 30, wherein the variable curvature may have predefined curvatures when the movable flap portion 70*a* is either in a stowed or in a deployed position.

In an embodiment of the invention, the upper peripheral edge 16 is substantially arcuate, however, the upper peripheral edge 16 may be formed from any symmetrical geometry including a polygonal geometry.

In one embodiment of the invention, the arc length of the curvilinear edge 80 of the movable flap portion 70*a* may range between, and include: 0.5 inches and 2.5 inches.

In an embodiment of the invention, the substantially arcuate peripheral edge 16 has a curvature that varies simultaneously along both an X-Z plane, and along an X-Y plane when the movable flap portion 70*a* pivots multiaxially about the X-Z plane.

An X-axis represents an axis along a horizontal plane and wherein a Z-axis represents an axis along a horizontal plane perpendicular to the X-axis and wherein a Y-axis represents an axis along a vertical plane perpendicular to the both the X-axis and the Z-axis.

The movable curvilinear edge 80 being formed by the two spring hinges 22 and an upper slot edge 46 of the slot 26.

The curvilinear edge 80 and a longitudinal axis of the slot define an arcuate spring hinge axis 24 having a curvature that varies along the X-Z plane when the movable flap portion 70*a* pivots multiaxially about the X-Z plane. The slot 26 cooperates with the hinges 22 having a hinge length HL (shown in FIG. 3) to allow the movable flap portion 70*a* to pivot thereabout while controlling a curvature of the spring hinge axis 24.

As shown in FIGS. 2-4, 5, 6, 7, and 9-14, the movable flap portion 70*a* includes an inner movable flap surface 18*a* (shown in FIGS. 4, 5, 6, 7, and 9-14), and an outer movable flap surface 20*a* (shown in FIGS. 1, 2, 3, 5, 6, 7, 9, 10, and 14).

Figure 5:
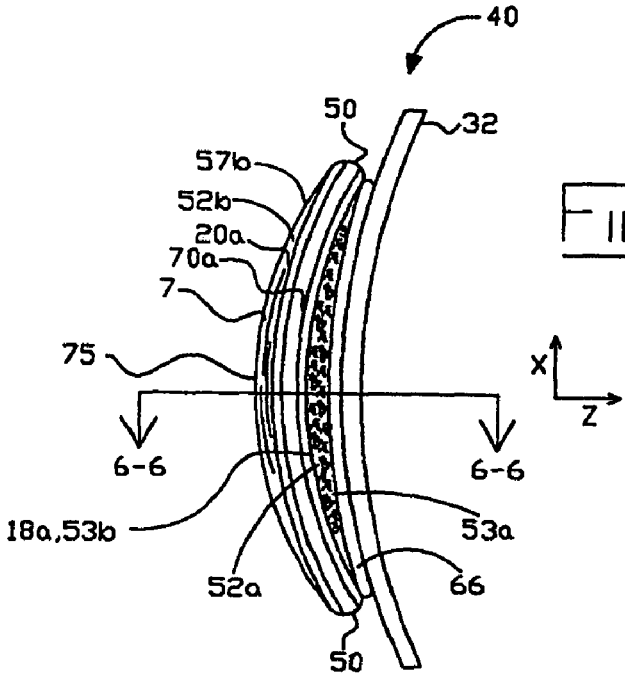
FIG. 5 illustrates a top plan view of the ear shading hat attachment inner movable surface 20*a* in FIG. 1.
Figure 9:
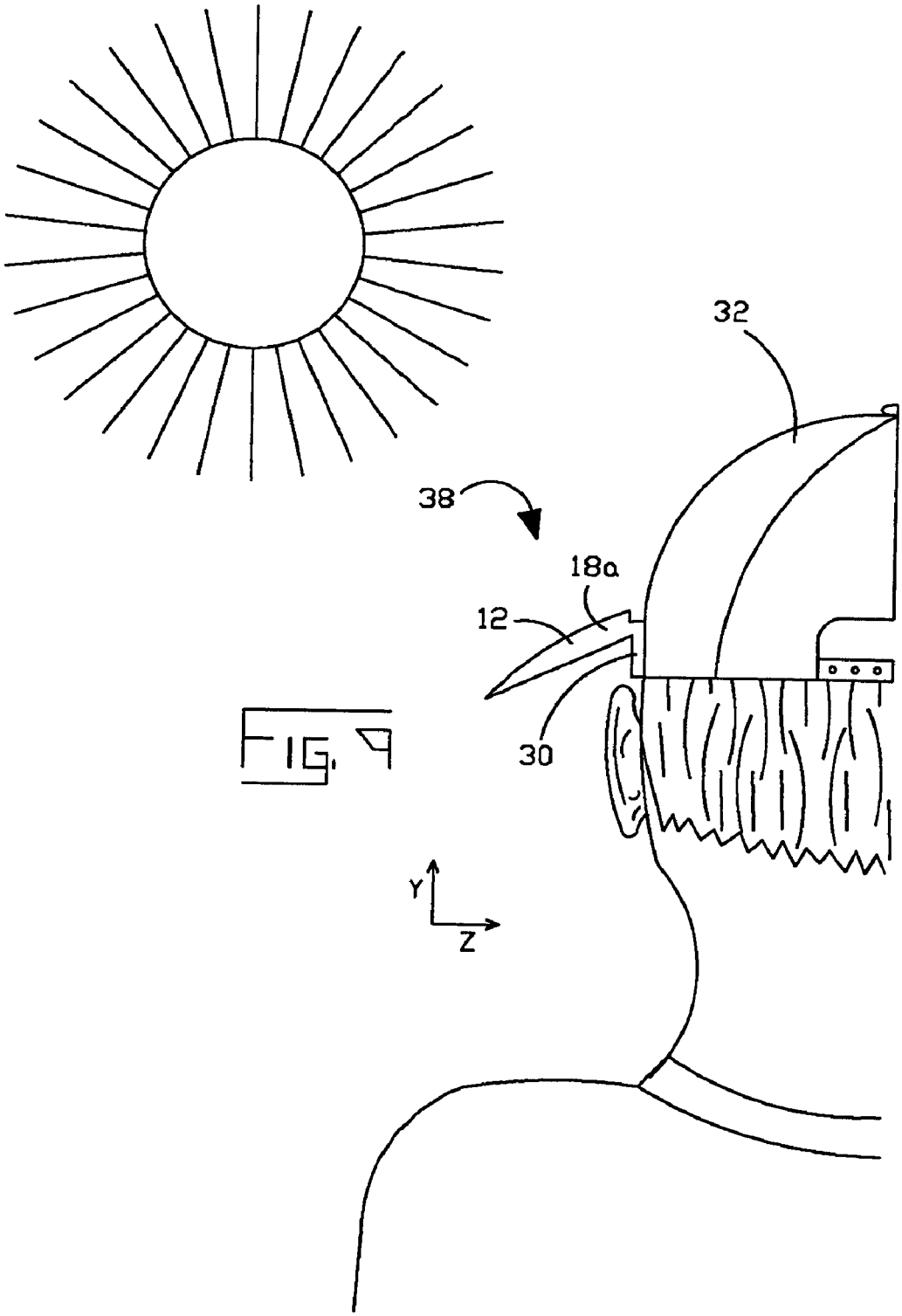
FIG. 9 illustrates a partial in-use view as viewed from a rear-end of the hat of an ear shading hat attachment and hat in accordance with one embodiment of the invention.
Figure 10:
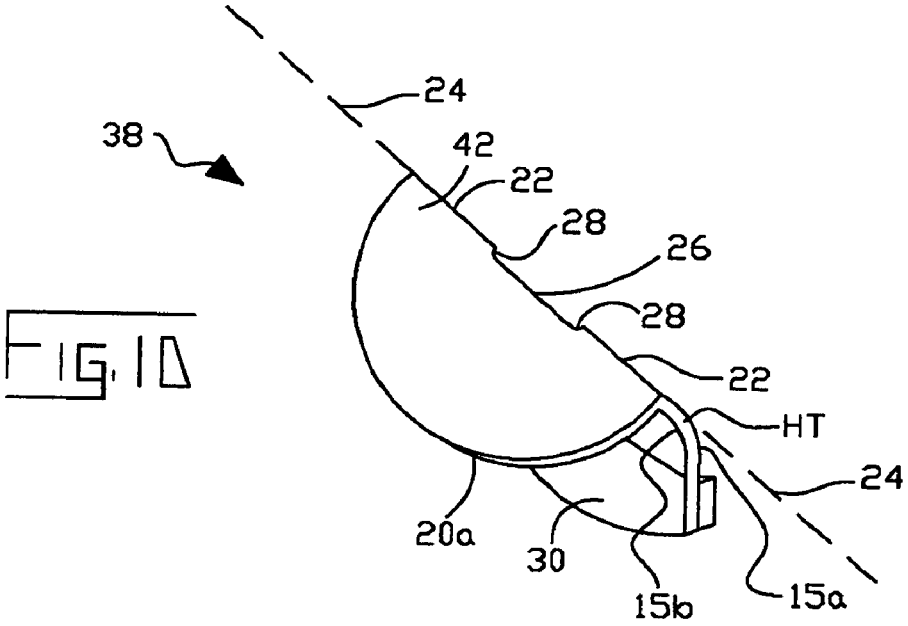
FIG. 10 illustrates a partial perspective view of an ear shading hat attachment in a deployed position in accordance with an embodiment of the invention.

In one embodiment of the invention, illustrated in FIGS. 5, 9, and 10, the movable flap portion 70*a* may form a three dimensional arcuate geometry that changes in accordance with the position of the movable flap portion 70*a* with respect to the base 30.

In an embodiment of the invention, as shown in FIG. 5, the flap portion 70*a* has a substantially concave geometry with respect to a hat 32 and a vertical plane when in a stowed position. More particularly, as shown in FIG. 5, the curvature of the movable flap portion 70*a* appears to be concave having an inner concave portion defined by the inner movable surface 18*a* facing the hat 32, and an outer concave portion defined by the outer movable surface 20*a* facing away from the hat.

In an embodiment of the invention, as shown in FIGS. 9, and 10, the flap portion 70*a* has a substantially convex geometry with respect to the hat 32 and a horizontal plane when in a deployed position.

In one embodiment of the invention, the inner movable flap surface 18*a* may include a reflective finish integrally formed thereupon.

In another embodiment of the invention, the inner movable flap surface 18*a* may include a reflective finish applied thereto. The reflective finish may be applied to the inner movable flap surface 18*a* by means including, but not limited to: adhesive decals, paints, adhesives, pressure-sensitive laminates, heat-activated adhesives, or any other means providing a reflective finish and capable of permanently or removably remaining in mechanical engagement with the inner movable flap surface 18*a*.

In another embodiment of the invention, the inner movable flap surface 18*a* may include integrally formed therewith a material adapted to be resistant to UV rays, and further adapted to provide protection therefrom for a user's ears.

Figure 11:
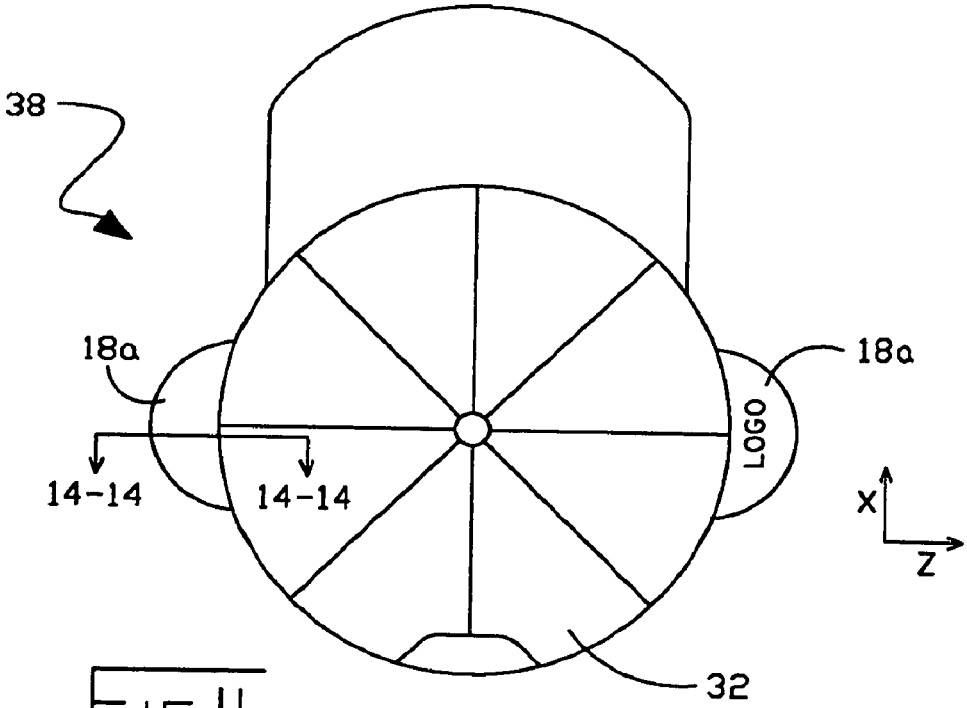
FIG. 11 illustrates a top plan view of an ear shading hat attachment in a deployed position and hat in accordance with one embodiment of the invention.
Figure 13:
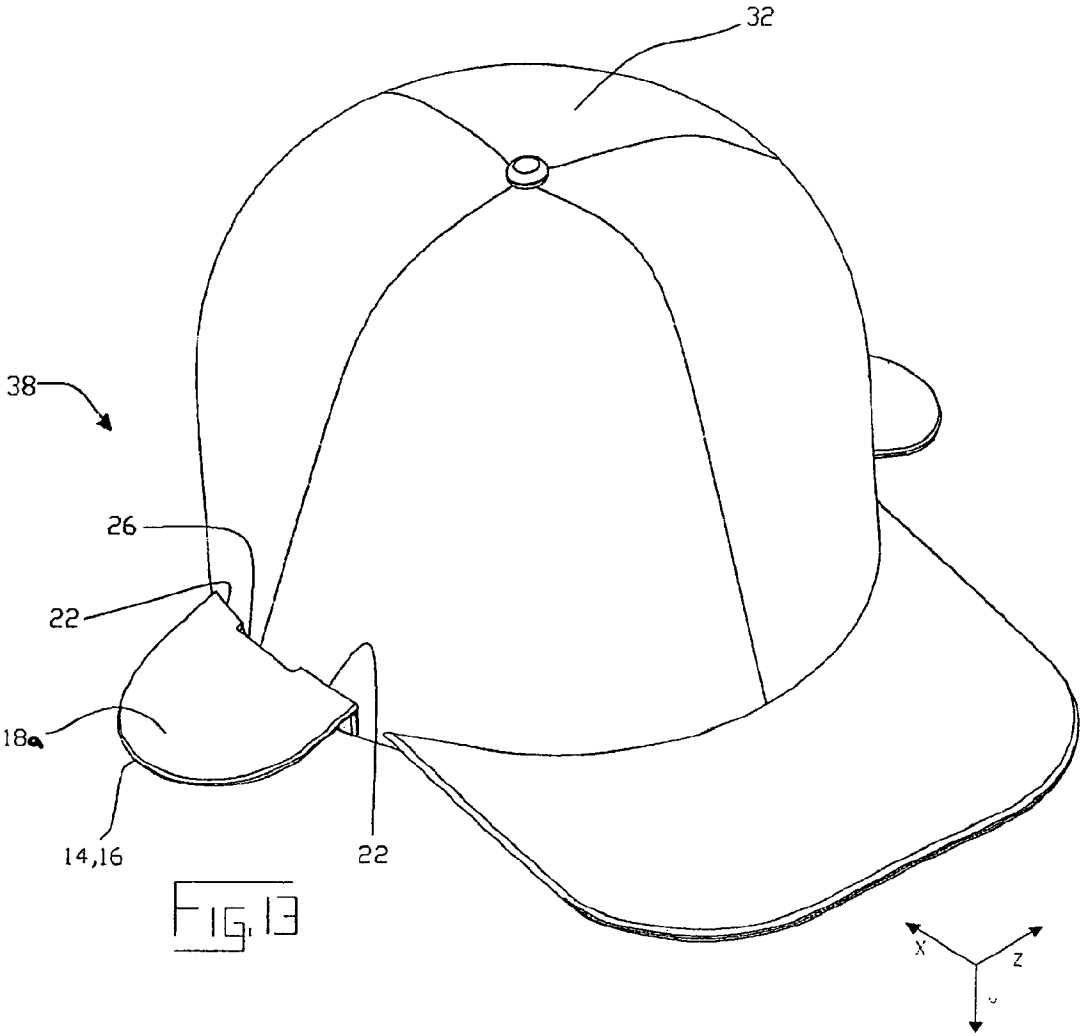
FIG. 13 illustrates a perspective view of an ear shading hat attachment in a deployed position in accordance with an embodiment of the invention.
Figure 14:
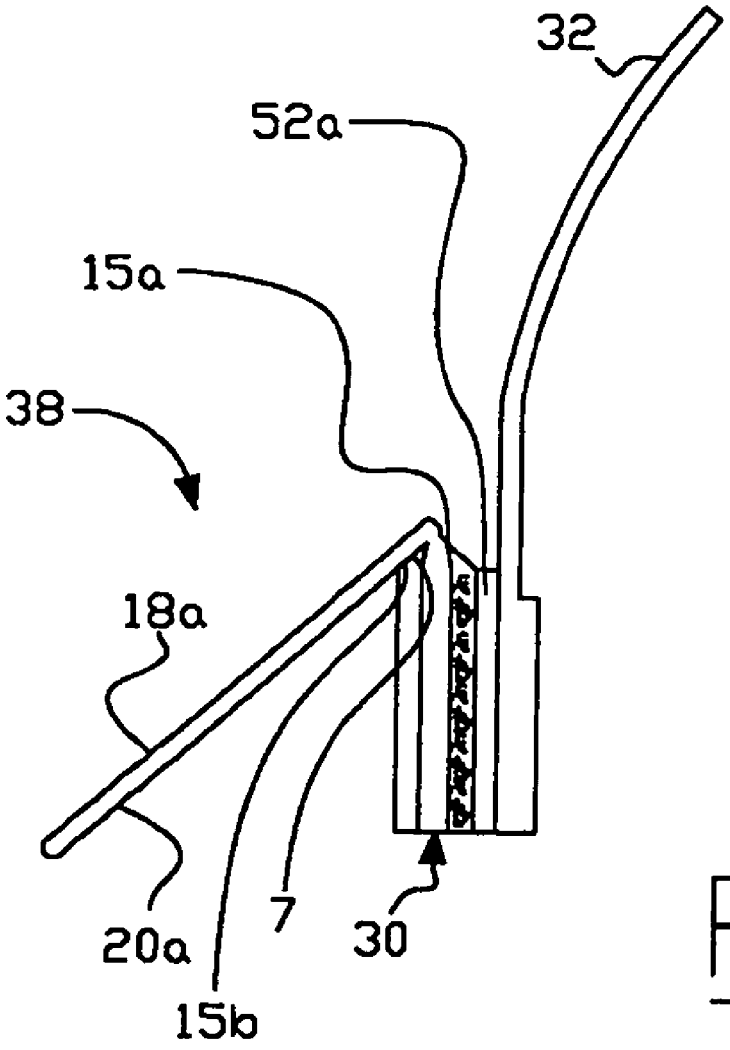
FIG. 14 illustrates a cross sectional view of the ear attachment and hat wherein the ear attachment is in a deployed position taken across section line 14-14 in FIG. 11.

In another embodiment of the invention, inner movable surface 20*a* in FIGS. 4, and 11, the inner movable flap surface 18*a* may include aesthetically pleasing indicia 36 imprinted thereupon or affixed thereto. The indicia 36 may include, but is not limited to: logos, slogans, pictures, or any other indicia desired by a user that may also be used for promotional purposes.

In an embodiment of the invention having indicia 36 formed upon or affixed to the inner movable flap surface 18*a*, the indicia 36 may be visible when the flap 12 is placed in a deployed position 38 (inner movable surface 18*a* in FIG. 11), and may not be visible when the flap 12 is placed in a stowed position 40 (outer movable surface 20*a* in FIGS. 1-4).

In another embodiment of the invention, the indicia 36 may be removably affixed to the inner movable flap surface 18*a*, whereby the indicia 36 may be removed therefrom by a user when desired.

In one embodiment of the invention, the indicia 36 may be removably affixed to the inner movable flap surface 18*a* by removable mechanical fastening means the removable mechanical fastening means including, but not limited to: hook and loop fasteners, removable adhesives, or any other removable mechanical fastening means providing sufficient mechanical fastening strength to retain the indicia in mechanical communication with the inner movable flap surface 18*a* while also permitting the indicia 36 to be removed from the inner movable flap surface 18*a* if desired.

In another embodiment of the invention, the indicia 36 may be placed in removable mechanical communication with the inner movable flap surface 18*a* via static charge, or "static cling" developed betwixt each of the indicia 36 and the inner movable flap surface 18*a*.

In another embodiment of the invention, the indicia 36 may be integrally formed with the inner movable flap surface 18*a*.

In an embodiment of the invention shown in FIGS. 1, 2, and 3, the outer movable flap surface 20*a* may include aesthetically pleasing indicia 36 imprinted thereupon or affixed thereto. The indicia 36 may include, but is not limited to: logos, slogans, pictures, or any other indicia desired by a user that may also be used for promotional purposes.

In one embodiment of the invention, the indicia may be removably affixed to the outer movable flap surface 20*a* by removable mechanical fastening means, the removable mechanical fastening means including, but not limited to: hook and loop fasteners, removable adhesives, or any other removable mechanical fastening means providing sufficient mechanical fastening strength to retain the indicia in mechanical communication with the outer movable flap surface 20*a* while also permitting the indicia 36 to be removed from the outer movable flap surface 20*a* if desired.

In another embodiment of the invention, the indicia 36 may be placed in removable mechanical communication with the outer movable flap surface 20*a* via static charge, or "static cling" developed betwixt each of the indicia 36 and the outer movable flap surface 20*a*.

In an embodiment of the invention having indicia 36 formed upon or affixed to the outer movable flap surface 20*a*, the indicia 36 may be visible when the movable flap portion 70*a* is placed in a stowed position 40 (shown in FIGS. 1, 2, and 3), and may not be visible when the flap 12 is placed in a deployed position 38, as shown in FIGS. 9, 10, 11, 12, 13 and 14.

In another embodiment of the invention, the indicia 36 may be removably affixed to the outer movable flap surface 20*a*, whereby the indicia 36 may be removed therefrom by a user when desired.

In another embodiment of the invention, the indicia 36 may be integrally formed with the outer movable flap surface 20*a*.

In one embodiment of the invention, the indicia 36 may include a heat-activated adhesive, commonly known as "iron-on". A non-limiting example of a heat-activated adhesive is disclosed in U.S. Pat. No. 5,411,783 issued in the name of John Mahn, Jr. and incorporated herein by reference in its entirety.

Figure 7:
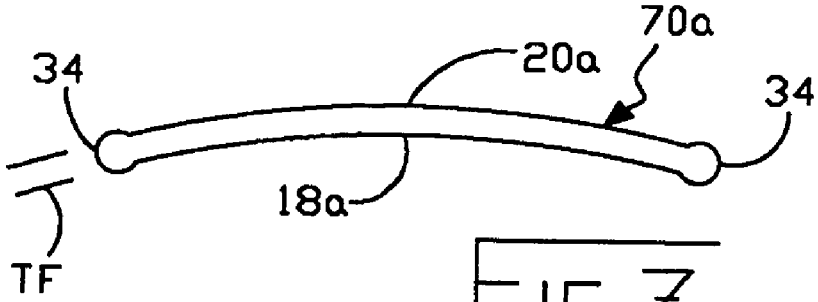
FIG. 7 illustrates a partial end view of a flap having an edge guard in accordance with one embodiment of the invention.
Figure 8:
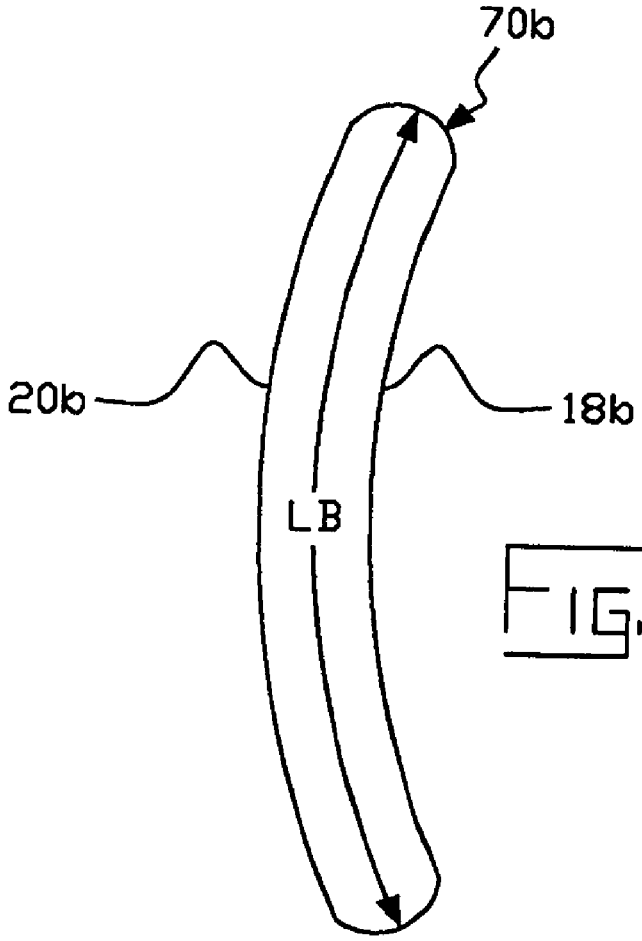
FIG. 8 illustrates a top cross-sectional view of a stationary base flap portion of the flap shown in FIG. 5.

As shown in FIG. 7, a distance between the inner movable flap surface 18*a*, and the outer movable flap surface 20*a* defines a flap thickness TF, whereby the flap thickness may affect the spring strength of the hinges 22.

In one embodiment of the invention, the flap thickness TF may range between and include: 0.050 inches and 0.125 inches.

In one embodiment of the invention, shown in FIG. 7, the flap peripheral edge 14 includes an edge guard 34, the edge guard 34 having a generally semi-circular cross-sectional profile and integrally formed with the flap peripheral edge 16. The edge guard 34 may operate to provide a smooth surface along the flap peripheral edge 14.

In another embodiment of the invention, the edge guard 34 may only be formed along a portion of the flap peripheral edge 16.

In another embodiment of the invention, the edge guard 34 may include a form having a cross-sectional profile other than semi-circular. Examples of cross-sectional profiles that the edge guard 34 may include, but are not limited to: polygonal and elliptical.

In another embodiment of the invention, the edge guard 34 may be formed upon the inner movable flap surface 18*a*, wherein the edge guard 34 may protrude over the flap peripheral edge 16.

In another embodiment of the invention, the edge guard 34 may be formed upon the outer movable flap surface 20*a*, wherein the edge guard 34 may protrude over the flap peripheral edge 16.

As shown in FIGS. 2-4, in an embodiment of the invention, the slot 26 is bound by an upper slot edge 46 associated with the movable flap portion 70*a*, a lower slot edge 48 associated with an upper peripheral edge of the stationary flap portion 70*b*, and two opposing slot ends 28. A distance between the upper slot edge 46, and the lower slot edge 48 defines a slot width WS (shown in FIG. 2); a distance between the two opposing slot ends 28 defines a slot length LS (shown in FIG. 3).

In one embodiment of the invention, the slot length LS determines the amount of the available spring strength of the spring hinges 22 that is used to retain the movable flap portion 70*a* in either the stowed position 40 (see FIGS. 1-8) or the deployed position 38 (see FIGS. 9-14). A longer slot length LS results in a lower amount of spring strength being applied to the movable flap portion 70*a*, while conversely, a shorter slot length LS results in a higher amount of spring strength being applied to the movable flap portion 70*a*.

In one embodiment of the invention, the spring hinge slot length LS may have a length dimension ranging between and including: 0.5 inches and 2 inches.

In an embodiment of the invention, shown in FIGS. 1, 2-4, 10, and 12, the slot 26 is disposed between the two spring hinges 22 such that a length of each spring hinge 22 (HL, shown in FIG. 3) is defined by an equal distance between an opposing end of the flap 12 and the slot 26.

In one embodiment of the invention, the slot 26 cooperates with each of the spring hinges 22 to securely retain the movable flap portion 70*a*, such that the movable flap portion 70*a* includes a predefined curvature in either of the stowed position 40 (see FIGS. 1, 2-4) or the deployed position 38 (see FIG. 10, 12).

As shown in FIG. 10, two spring hinges 22 are formed on opposing ends 28 of the spring hinge slot 26 and are each adapted to hingably retain the movable flap portion 70*a* in mechanical engagement with the base 30.

In an embodiment of the invention, each spring hinge 22 is associated with the spring hinge axis 24 (shown in FIG. 3).

Each spring hinge 22 may be integrally formed with each of the movable flap portion 70*a* and the base 30.

In an embodiment of the invention shown in FIG. 10, each respective lower spring hinge 22 includes an associated spring hinge thickness HT, the spring hinge thickness HT defined by an outer spring hinge surface 15*b* and an inner spring hinge surface 15*a*.

In one embodiment of the invention, as shown in FIGS. 2, 4, and 10, the outer spring hinge surface 15*b* may be formed such that the outer spring hinge surface 15*b* is coplanar with inner movable flap surface 18*a* and the inner spring hinge surface 15*a* may be formed such that the inner spring hinge surface 15*a* is coplanar with the outer movable flap surface 20*a*, whereby the spring hinge thickness HT is substantially equal to the flap thickness TF (shown in FIG. 7).

In another embodiment of the invention each of the spring hinges 22 may be adapted to pivot multi-axially (see FIG. 10), with each respective spring hinge 22 pivoting about at least the spring hinge axis 24 and a vertical axis, whereby each of the respective spring hinges 22 cooperate with one another and with the spring hinge slot 26 to retain the movable flap portion 70*a* at a predefined curvature in each of the stowed position 40 (not shown in FIG. 10) and the deployed position 38.

In an embodiment of the invention including spring hinges 22 adapted to pivot multi-axially, each respective spring hinge 22 may be formed of an elastically deformable material, whereby each respective spring hinge 22 may pivot about one or more axes by deforming in several directions simultaneously, whereafter when completion of the pivoting between a stowed or a deployed position, each respective spring hinge 22 returns to an initial shape, thereby retaining a predefined curvature in the movable flap portion 70*a*.

In one embodiment of the invention, each of the spring hinges 22 are adapted to cooperate with one another and with the spring hinge slot 26 to allow the movable flap portion 70*a* to selectively move from a stowed position 40 (shown in FIGS. 1, 2-4) to a deployed position 38 (shown in FIGS. 9-14) and from a deployed position 38 to a stowed position 40.

When the movable flap portion 70*a* pivots about the arcuate spring hinge axis 24, and about the stationary base 30, the spring hinges 22 flexes, thereby causing tensioning of the spring hinges 22. When the movable flap portion 70*a* is in the stowed position, the spring hinges are minimally flexed, and thus receive a minimal tension or load, and when the movable flap portion 70*a* is in the deployed position, the spring hinges are maximally flexed, and thus receive a maximum tension or load. Maximum flexing of the spring hinges causes tensioning of the movable flap portion 70*a* and thus causes the movable flap portion 70*a* to remain in a deployed position.

Figure 6:
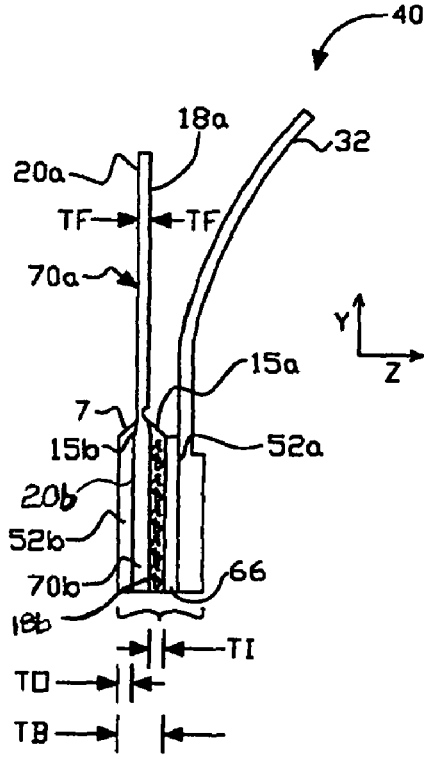
FIG. 6 illustrates a cross-sectional view of the hat attachment taken across section line 6-6 inner movable surface 20*a* in FIG. 5.

Referring in more detail to FIGS. 2, 4, and 6 in one embodiment of the invention, the base 30 is hingably affixed to the movable flap portion 70*a* by the spring hinges 22, having a predefined curvature, and adapted to be fixed in secure mechanical engagement to a hat 32.

The base 30 includes a stationary flap portion 70*b* (see FIGS. 6, 8) including an inner base flap surface 18*b* and an outer base flap surface 20*b* (see FIG. 8), two opposing base ends 50 in FIG. 12 wherein a length LB of flap portion 70*b* is defined by a curvilinear or linear distance along the flap portion 70*b* between the two opposing base ends 50 (see FIG. 12); an inner base support 52*a* having first inner base support outer surface 52*b* engaging or integrally formed with the inner base flap surface 18*b*, and a second inner base support inner surface 53*a* engaging or integrally formed with a fastener material or with the hat (see FIG. 5); an outer base support 52*b* having a first outer base support surface 57*a* engaging or integrally formed with the outer base flap surface 20*b* and a second outer base support surface 57*b* facing outwardly away from the hat.

In an embodiment of the invention as shown in FIG. 6, outer support 52*b* has a thickness TO, inner base support 52*a* has a thickness TI, wherein TO and TI each vary in thickness across a length of each support 52*a*, 52*b*, respectively.

As shown in FIG. 5, each of the widths TO, TI equals or ranges between a maximum thickness value (as shown in 6) taken at a centerpoint 75 (as shown in FIG. 5) of a distance between opposing ends 50 of the base 30 and a minimum thickness value at each end 50. Each thickness TI, TO in combination with the flap thickness TF, when combined, cooperate to define a base thickness TB (shown in FIG. 6). The stationary flap portion 70*b* has an upper base edge 58 and a lower base edge 60 (shown in FIG. 4). The upper base edge 58 that abuts each of the spring hinges 22 and the lower slot edge 48 of the spring hinge slot 26.

In an embodiment of the invention, the base 30 includes a predefined radius, wherein the predefined radius is coplanar with each of the upper base edge 58 and the lower base edge 60 (shown in FIG. 4) such that each of the inner base support 52*a*, the outer base support 52*b* bounded by the upper, and lower base edges 58, 60 include a predefined curvature.

In another embodiment of the invention, the base 30 is rigidly formed and adapted to retain the base 30 in a predefined curvature, whereby the base 30 in combination with the hinges 22 causes the movable flap portion 70*a* to maintain a corresponding curvature ranging between or equal to a predefined maximum and minimum curvature through mechanical engagement thereto.

In an embodiment of the invention, shown in FIGS. 5, 6, 4, 12, and 14, the second inner base surface 53*b* includes attachment means 66, whereby the base 30 may be placed in mechanical engagement with a hat 32.

In an embodiment of the invention shown in FIG. 12, the attachment means 66 includes removable mechanical fasteners 64, the removable mechanical fasteners 64 being adapted to allow the base 30 to be selectively attached or detached to a hat 32.

In another embodiment of the invention, the removable mechanical fasteners 64 may include, but are not limited to: hook and loop fasteners, snaps, magnets, or any other mechanical fastener that is adapted to provide sufficient fastening strength to retain the base 30 in mechanical engagement with the hat and that permits the base 30 to be easily removed from the hat 32.

In another embodiment of the invention shown in FIG. 12, the removable mechanical fasteners 64 may include a first mechanical fastener portion 68*a* in secure mechanical engagement with the second inner base support surface 53*a* (shown in FIG. 5) and a second mechanical fastener portion 68*b*, the second mechanical fastener portion 68*b* securably affixed to the hat, wherein each of the first mechanical fastener portion 68*a* and the second mechanical fastener portion 68*b* cooperate to removably retain the base 30 in mechanical engagement with the hat 32.

In another embodiment of the invention shown in FIGS. 5 and 6, the attachment means 66 may include mechanical fasteners adapted to fixably secure the base 30 in a desired position relative to the hat 32. Examples of mechanical fasteners suitable for securing the base 30 to the hat 32 include, but are not limited to: rivets, adhesives, stitching, and any other mechanical fasteners providing sufficient fastening strength to retain the base 30 to the hat 32.

In one embodiment of the invention, the mechanical fastener adapted to fixably secure the base 30 to the hat 32 may include a heat-activated adhesive, commonly known as an "iron on". A non-limiting example of a heat-activated adhesive is disclosed in U.S. Pat. No. 4,248,748 issued in the name of McGrath et al. and incorporated herein in its entirety.

In one embodiment of the invention, illustrated in FIGS. 2, 5, 6, and 14, outer support 52*b* protrudes outwardly away from the hat and from the stationary outer flap surface 20*b* and includes an angular portion having a minimal thickness at the slot lower edge 48 and a maximum thickness at a region extending a predefined distance below the lower edge 48 to define a flap rest stop 7, the flap rest stop 7 adapted to mechanically engage the outer movable flap surface 20*a* and retain the outer movable flap surface 20*a*, and thus the flap 12, at a predefined angle relative to the hat 32.

The flap rest stop 7 may include a desired geometrical cross-sectional profile that operates to limit the downward travel of the movable flap portion 70*a* when the movable flap portion 70*a* is moved into the deployed position 38. Therefore, differing geometrical cross-sectional profiles formed upon the flap rest stop 7 will provide different angles of the movable flap portion 70*a* in the deployed position 38, relative to the base 30.

Additionally, the outer support 52*b* protrudes curvilinearly outwardly from the stationary outer flap surface 20*b* and tapers from a minimum thickness at opposing ends 50 of the base 30 and increases to a maximum thickness at a centerpoint located a distance equidistant from the ends 50.

In an embodiment of the invention, spring regions 15*a* (associated with inner stationary flap portion 70*a*), and 15*b* (associated with outer stationary flap portion 70*b*) cooperate with the inner support 52*a*, and outer support 52*b*, respectively to further provide a load or tensioning of the spring regions 15*a*, 15*b* and spring hinges 22. The tensioning may be adjusted by changing the geometry of the of the spring regions, shown as triangular regions 15*b* in FIGS. 2, and 15*a* in FIG. 4, by changing the density and thereby the elasticity of the material used to form spring regions 15*a, b*, respectively, or a combination thereof.

In one embodiment of the invention shown in FIG. 2, the base 30 may include indicia 36 affixed thereto or imprinted thereupon. The indicia 36 may include any indicia 36 having aesthetically desirable characteristics. The indicia 36 may include, but is not limited to: logos, slogans, pictures, or any other indicia desired by a user that may also be used for promotional purposes.

In another embodiment of the invention shown in FIG. 2, the indicia 36 formed upon the base 30 may be separate and distinct from the indicia 36 that may be formed upon the outer movable flap surface 20*a*.

In another embodiment of the invention, the indicia formed upon the base 30 may be integrally formed with indicia 36 formed upon the outer movable flap surface 20*a*, such that when the movable flap portion 70*a* is in a stowed position 40, the indicia 36 formed upon each of the outer movable flap surface 20*a* and the base 30 cooperate to form a single indicia 36.

In operation, the base 30 may operate to limit the downward travel of the movable flap portion 70*a* when the movable flap portion 70*a* is moved into the deployed position 38, whereby the outer movable flap surface 20*a* stops either when the spring hinges 22 have reached a maximum flexure point or when the outer movable flap surface 20*a* contacts the upper base edge 58, thereby preventing the movable flap portion 70*a* from pivoting further in a downward direction relative to the upper base edge 58. The flap rest stop 7 may cooperate with each of the upper base edge 58 and the outer movable flap surface 20*a* to define the position at which the flap 12 stops when pivoted downwardly into the deployed position 38. The flap rest stop 7 operates to determine the deployed position 38 of the flap 12, while the spring hinges 22 remain under load, whereby the flap 12 is maintained in secure mechanical engagement with the flap rest stop 7.

The predefined curvature associated with the flap 12 cooperates with each of the spring hinges 22 and the base 30 to securely retain the flap 12 in either the stowed position 40 or the deployed position 38, the deployed position 38 including the outer movable flap surface 20*a* being held in secure mechanical engagement with the flap rest stop 7.

While several aspects have been presented in the foregoing detailed description, it should be understood that a vast number of variations exist and these aspects are merely an example, and it is not intended to limit the scope, applicability or configuration of the invention in any way. Rather, the foregoing detailed description provides those of ordinary skill in the art with a convenient guide for implementing a desired aspect of the invention and various changes can be made in the function and arrangements of the aspects of the technology without departing from the spirit and scope of the appended claims.

What is claimed is:

1. An ear shading hat attachment comprising:

a flap, the flap including a movable flap portion having an outer flap periphery defined by a flap peripheral edge, an inner movable flap surface, and an outer movable flap surface, wherein each of the inner flap surface, the outer movable flap surface, and the flap peripheral edge cooperate to define a flap thickness;

at least two spring hinges, each spring hinge having an associated spring hinge axis coaxial with each other respective spring hinge axis and formed on opposing ends of a spring hinge slot and adapted to hingably retain the flap in mechanical engagement with a stationary base;

a spring hinge slot, the spring hinge slot having two opposing slot ends and having a predefined length and a predefined width and adapted to allow each of the flap and each respective spring hinge to pivot thereabout while retaining a predefined curvature; and a stationary base, the stationary base hingably affixed to the flap by the spring hinges, having a predefined curvature, and adapted to be fixed in secure mechanical engagement to a hat.

2. The ear shading hat attachment of claim 1, wherein the flap further comprises:

an arcuate form having a predefined radius associated therewith and defined by the flap peripheral edge, with an associated arc length of the radius defined by the spring hinges and formed collinearly with the spring hinge axes.

3. The ear shading hat attachment of claim 2, further comprising:

an edge guard, the edge guard having a generally circular cross-sectional profile and integrally formed with the flap peripheral edge, wherein the edge guard may operate to provide a smooth surface along the flap peripheral edge.

4. The ear shading hat attachment of claim 2, wherein the inner movable flap surface further comprises:

a material adapted to be resistant to UV rays, and further adapted to provide protection therefrom for a user's ears.

5. The ear shading hat attachment of claim 4, wherein the inner movable flap surface further comprises:

aesthetically pleasing indicia imprinted thereupon or affixed thereto.

6. The ear shading hat attachment of claim 4, wherein the outer movable flap surface further comprises:

aesthetically pleasing indicia imprinted thereupon or affixed thereto.

7. The ear shading hat attachment of claim 6, wherein the indicia is removably affixed to the outer movable flap surface by removable mechanical fastening means.

8. The ear shading hat attachment of claim 6, wherein the indicia is integrally formed with the stationary outer flap surface.

9. The ear shading hat attachment of claim 3, wherein each of the spring hinges are adapted to cooperate with one another and with the spring hinge slot to allow the flap to selectively move about an arcuate spring hinge axis having a curvature that varies along an X-Z plane when the movable flap portion pivots multiaxially about the X-Z plane from a stowed position to a deployed position and from a deployed position to a stowed position.

10. The ear shading hat attachment of claim 9, wherein each of the spring hinges are adapted to pivot multi-axially, with each respective spring hinge pivoting about the arcuate spring hinge axis and a vertical axis, whereby each of the respective spring hinges cooperate with one another and with the spring hinge slot to retain the flap at a predefined curvature in each of the stowed position and the deployed position.

11. The ear shading hat attachment of claim 10, further comprising:

each respective spring hinge formed of an elastically deformable material, whereby each respective spring hinge may pivot about one or more axes by deforming in several directions simultaneously, whereafter each respective spring hinge returns to an initial shape, thereby retaining a predefined curvature in the flap.

12. An ear shading hat attachment comprising:

a flap, the flap including a movable flap portion including an outer flap periphery defined by a flap peripheral edge, an inner movable flap surface, and an outer movable flap surface, wherein each of the inner movable flap surface, the outer movable flap surface, and the flap peripheral edge cooperate to define a flap thickness;

at least two spring hinges, each spring hinge having a respective coaxial spring hinge axis and formed on opposing ends of a spring hinge slot and adapted to hingably retain the flap in mechanical engagement with a stationary base;

a spring hinge slot, the spring hinge slot having opposing slot ends, each of the opposing slot ends abutting one of the at least two spring hinges, an upper slot edge abutting the flap, a lower slot edge abutting the stationary base, a slot width defined by a distance between the upper slot edge and the lower slot edge, and a slot length defined by a distance between the opposing slot ends; and a stationary base, the stationary base having an inner base support inner surface, an outer base support surface that cooperates with the inner base support inner surface to define a base thickness, an upper base edge having a base length abutting each of the spring hinges and the spring hinge slot, and a lower base edge having a base edge length equal to the upper base edge length, wherein a distance between the upper and lower base edges defines a base width.

13. The ear shading hat attachment of claim 12, wherein the stationary base further comprises:

a predefined radius, the predefined radius coplanar with each of the upper base edge and the lower base edge such that each of the inner base support inner surface, the outer base support surface, the upper base edge, and the lower base edge include a predefined curvature.

14. The ear shading hat attachment of claim 13, wherein the stationary base is rigidly formed and includes a predefined curvature, whereby the stationary base causes the flap to retain a corresponding predefined curvature through mechanical engagement thereto via the at least two spring hinges.

15. The ear shading hat attachment of claim 14, wherein the upper base edge further comprises:

a flap rest stop, the flap rest stop adapted to mechanically engage the outer movable flap surface and retain the outer movable flap surface, and thus the flap, at a predefined angle relative to a hat worn by a user.

16. The ear shading hat attachment of claim 15, wherein the inner base support inner surface further comprises:

attachment means, whereby the stationary base may be placed in mechanical engagement with a hat.

17. The ear shading hat attachment of claim 16, where the attachment means further comprises:

removable mechanical fasteners, the removable mechanical fasteners adapted to allow the stationary base to be selectively attached or detached to a hat.

18. The ear shading hat attachment of claim 17, wherein the removable mechanical fasteners further comprise:

a first mechanical fastener portion in secure mechanical engagement with the inner base support inner surface, and a second mechanical fastener portion, the second mechanical fastener portion securably affixed to the hat, wherein each of the first mechanical fastener portion and the second mechanical portion cooperate to removably retain the stationary base in mechanical engagement with the hat.

19. The ear shading hat attachment of claim 18, wherein the base further comprises:

indicia affixed thereto or imprinted thereupon.

20. The ear shading hat attachment of claim 16, wherein the attachment means further comprises:

mechanical fasteners adapted to fixably secure the stationary base in a desired position relative to the hat.

* * * * *